US011088475B1

(12) United States Patent
Meek et al.

(10) Patent No.: US 11,088,475 B1
(45) Date of Patent: Aug. 10, 2021

(54) SELF-ALIGNED PRINTED TERMINALS FOR FFC-STYLE CONNECTORS

(71) Applicants: Brian Nelson Meek, Boise, ID (US); Darrell Eugene Leber, Jr., Nampa, ID (US)

(72) Inventors: Brian Nelson Meek, Boise, ID (US); Darrell Eugene Leber, Jr., Nampa, ID (US)

(73) Assignee: American Semiconductor, Inc., Boise, ID (US)

( * ) Notice: Subject to any disclaimer, the term of this patent is extended or adjusted under 35 U.S.C. 154(b) by 0 days.

(21) Appl. No.: 16/684,015

(22) Filed: Nov. 14, 2019

Related U.S. Application Data

(60) Provisional application No. 62/769,147, filed on Nov. 19, 2018.

(51) Int. Cl.
*H01R 12/70* (2011.01)
*H01R 12/79* (2011.01)

(52) U.S. Cl.
CPC ..... *H01R 12/7005* (2013.01); *H01R 12/79* (2013.01)

(58) Field of Classification Search
CPC .... H01R 12/7005; H01R 12/79; H01R 12/65; H01R 12/78; H01R 12/82
See application file for complete search history.

(56) References Cited

U.S. PATENT DOCUMENTS

| | | | | |
|---|---|---|---|---|
| 6,093,055 | A | 7/2000 | Sakano | |
| 6,129,573 | A | 10/2000 | Juntwait et al. | |
| 6,394,833 | B1 * | 5/2002 | Bulmer | H01R 12/675 439/393 |
| 7,137,838 | B2 | 11/2006 | Koga | |
| 7,625,232 | B2 | 12/2009 | Lin et al. | |
| 7,731,505 | B2 * | 6/2010 | Chen | H01R 12/65 439/67 |
| 2011/0053390 | A1 | 3/2011 | Huang | |
| 2013/0260582 | A1 * | 10/2013 | White | H01R 13/5213 439/149 |
| 2019/0165502 | A1 * | 5/2019 | Hiroki | H01R 35/04 |

* cited by examiner

*Primary Examiner* — Briggitte R. Hammond
(74) *Attorney, Agent, or Firm* — Your Intellectual Property Matters, LLC; Robert A. Frohwerk

(57) ABSTRACT

The described devices and methods facilitate optimal control of contact surfaces for Flat Flexible Cable (FFC) connectors, especially of a Zero-Insertion-Force (ZIF) format. Terminal alignment guides, in the form of edge supports added to the terminal base of the primary conductor of the described Self-Aligned Connector, prevent slippage from side to side as a ZIF connector applies force to press its receptacle pins against the terminals of the FFC, thereby reducing wear of the connections. Flared ends of the conductor tails prevent misalignment of multi-terminal connectors. End stops inserted within the FFC connector tails serve to control depth of insertion to facilitate impedance matching.

5 Claims, 4 Drawing Sheets

SELF-ALIGNED PRINTED TERMINALS FOR FFC-STYLE CONNECTORS

CROSS-REFERENCES TO RELATED APPLICATIONS

This application claims benefit of U.S. Provisional Application No. 62/769,147 filed Nov. 19, 2018, entitled "Self-Aligned Printed Terminals for FFC-Style Connectors", which is incorporated here by reference in its entirety.

FIELD OF THE INVENTION

The device and methods described here relate generally to an electrical cable connector. Specifically, the described device is an electrical terminal that provides a self-aligning termination for a Flat Flexible Cable (FFC).

BACKGROUND OF THE INVENTION

Flat Flexible Cable (FFC) connectors are commonly used when a physically thin electrical connection is necessary for saving space and are frequently found in laptops and other portable electronic devices. The versatility of these connections has been demonstrated to be advantageous in Rigid Flex and printed electronics in making connections to other Rigid Flex, Printed Circuit Boards (PCB), and other electronic components. Due to the narrow signal trace pitch of these connectors, which may be as small as 0.008", the wear-rate and signal transmission integrity of the connection is intimately related to alignment.

Printed electronics systems are typically fabricated on a flexible substrate with printed silver conductors. A 'tail' is printed as part of the printed electronics system for connecting signals to a FFC-style receptacle, eliminating the need for an FFC cable. In addition, printed electronics systems are typically die cut or laser cut to their final form-factor, yielding significant variance in the width of the tail portion to be inserted into the FFC-style receptacle.

Silver is relatively soft and wears quickly with insertion and removal from the FFC-style receptacle; the tail of printed electronics tends to 'slip' side-to-side in the FFC-style receptacle, causing connections to fail. The printed electronics industry has combated this issue using a method of printing carbon material over the top of the silver at the connection terminal to make the connection to the FFC-style receptacle more mechanically robust and less prone to wear by the connection pressure of the connector. However, the electrical conductivity of the carbon is only about 1% of that of the silver, creating an undesirable contact resistance at the connection terminal interface. The voltage drop created by this connection is especially problematic for printed electronics systems running at low voltages.

BRIEF SUMMARY

Self-aligned printed terminals for FFC-style connectors solve the problems of wear and signal transmission integrity by creating an edge-supported signal connection which acts as a self-aligning guide for the connection terminal to compensate for variation in tail cut width. Furthermore, the topology of these printed features increases the surface area of the connection interface, significantly reducing the wear on the silver surfaces, thereby reducing the necessity for a carbon coating, though leaving it as an option, while reducing the overall resistance of the connection. End stops control the depth of penetration of the contact to maintain uniformity of impedance.

BRIEF DESCRIPTION OF THE DRAWINGS

Particular features and advantages of the described device will become apparent from the following description taken in conjunction with one or more of the accompanying FIGS. 1-5 of the drawings:

FIG. 2A is an isometric view of a single contact with alignment guides, while

The following Reference Numbers may be used in conjunction with one or more of the accompanying FIGS. 1-5 of the drawings:

100 Tail; composed of 130, 140 and 150
110 Terminal Base, primary male conductor
120 Terminal Alignment Guide
130 Connection Terminal, composed of 110 and 120
140 Flexible Substrate
150 Interconnect
180 Flare
190 End Stop
200 Self-Aligned Connector
210 FFC Receptacle Body
220 FFC Female Receptacle Pin

DETAILED DESCRIPTION

Mating of a Flat Flexible Cable (FFC) to a printed circuit board (PCB) is commonly accomplished by using a ZIF (Zero Insertion Force) connector in order to minimize wear of the narrow contacts. The terminal system described here offers an improved terminal for the male end of a conventional ZIF connector.

Figure 1A:
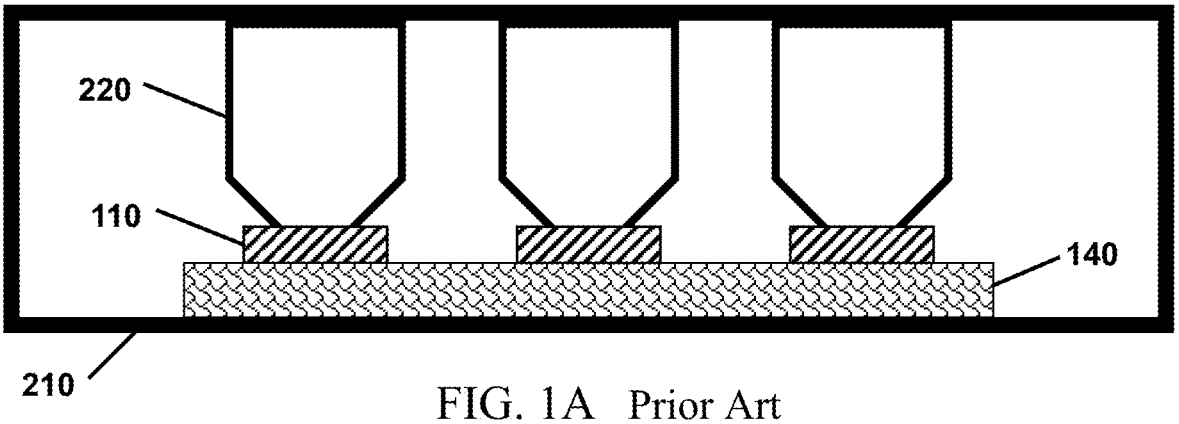
FIG. 1A Prior Art
FIG. 1A shows the traditional wear interface in a schematic front view of an exemplary three connector terminal in the prior art, while FIG. 1B and FIG. 1C demonstrate the problem of misaligned connectors in the prior art.
Figure 1B:
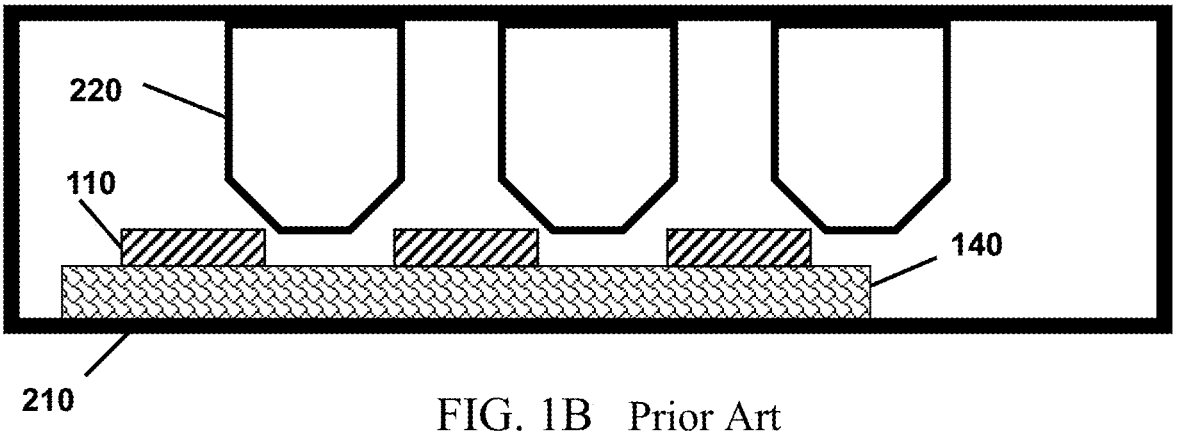
FIG. 1B Prior Art
Figure 1C:
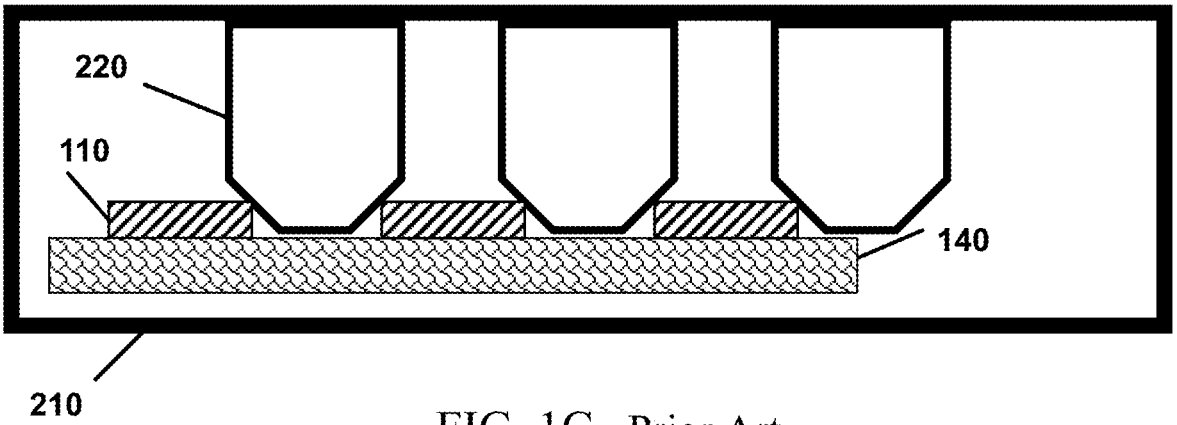
FIG. 1C Prior Art

As seen in FIG. 1A-1C, depicting the prior art, the male conductor is commonly a printed terminal affixed to a substrate. Formed from a conductive material, it is either screened or deposited onto a circuit board or flexible substrate 140. As such, Terminal Base 110, the primary male conductor, appears as a plateau which may have a sloped or domed surface. During proper operation as shown in FIG. 1A, when a ZIF tail is inserted into the FFC Receptacle Body 210, the conductor Terminal Base 110 makes electrical connection to the corresponding conductor of the FFC Female Receptacle Pin 220. When a clamping force is applied from the female side of the connector, FFC Receptacle Pin 220, the corresponding plateau tends to cause the male conductor 110 to slide sideways, particularly if the surface is sloped or domed. This can lead to open circuits as illustrated in FIG. 1B. Many ZIF connectors use a slide or hinge to lock the male conductor into place after insertion, though some versions rely solely on a pressure fit. In any instance, the conductors are easily misaligned. In the extreme, the male conductors of a multi-terminal connector may be pressed inadvertently into the spaces between the traces of the female conductors causing multiple short circuits, as illustrated in FIG. 1C of the prior art.

Figure 2A:
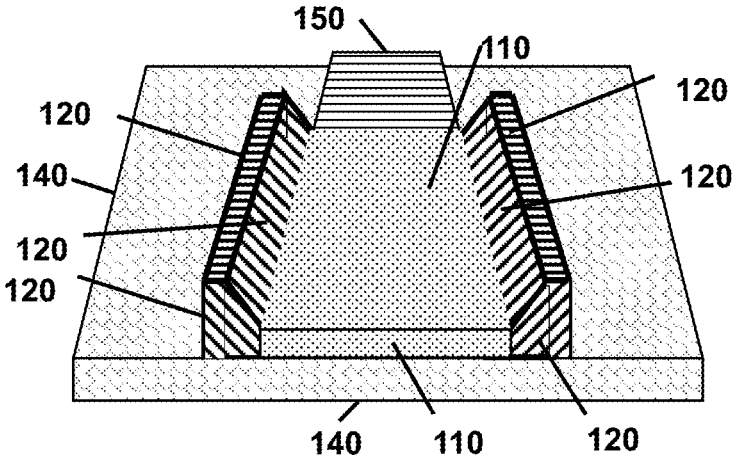
Figure 2B:
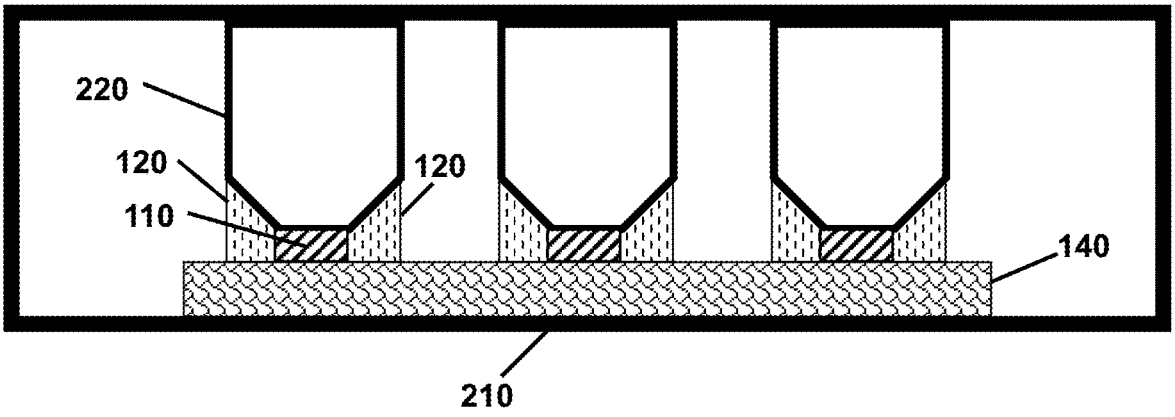
FIG. 2B is a schematic front view showing the wear interface of an exemplary three terminal self-aligned connector of the present design.

The design presented here, beginning with FIG. 2A, reshapes the printed terminal on the male conductor to maintain alignment. This is accomplished by reshaping the male conductor with the addition of a Terminal Alignment Guide 120 in the form of a pair of sidewalls which extend vertically from the substrate 140 upward on opposing sides of the Terminal Base 110 to create an enhanced Connection Terminal 130, as illustrated in FIG. 2A. With the tops of the sidewalls made to slope taller than the Terminal Base 110 and preferably sloping inward to form a channel over the Terminal Base 110, as seen in FIG. 2B, this structure directs alignment of the male conductor to provide improved contact for automatic alignment of the electrical traces on the male end when mating to the electrical conductors as it is captured by the female end.

Figure 3:
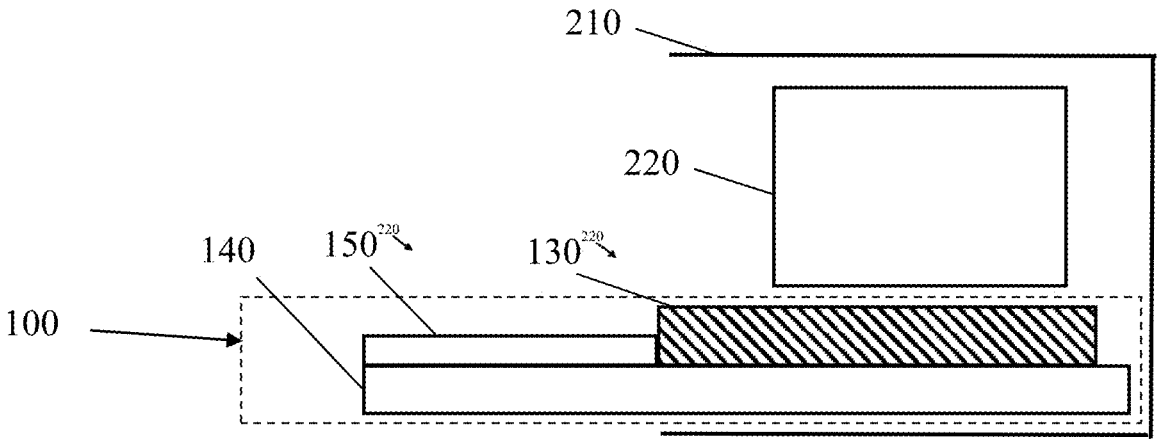
FIG. 3 depicts a side view of a single terminal of the present design.

FIG. 3 depicts a side view of a male Tail 100 inserted into the female FFC Receptacle Body 210 with a single terminal Connection Terminal 130 of the present design. Here it can be seen that the newly designed self-aligning Connection Terminal 130 has been applied to the substrate 140, which carries the interconnect 150. The composite of these three elements forms the tail 100 at the male end of the FFC. As the FFC-Style Receptacle Body 210 is operated to capture the tail 100, the receptacle pin 220 is pressed onto the self-aligning connection terminal 130. It is not feasible to show this self-alignment feature in this side view as it occurs in a dimension orthogonal to into the page.

Figure 4:
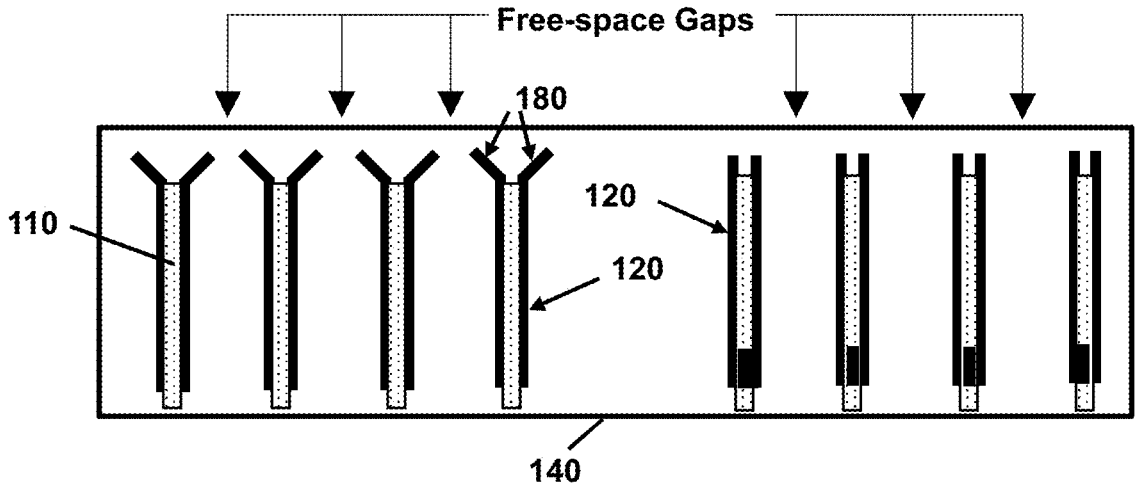
FIG. 4 illustrates a top view of a multi-terminal connector, where some terminals have flared ends.

The top view of a multi-terminal ZIF tail in FIG. 4 (see new update with additional detail on slide 7) shows two options for the Terminal Alignment Guides 120. The four terminals in the right half of FIG. 4 appear as standard with open ends, whereas the four terminals to the left are extended with the addition of flares 180 at their otherwise open ends, nearer the end of the male FFC Tail that will be inserted into the FFC Receptable Body. The flares 180 extend outward horizontally away from the terminal base 110 to narrow the gaps between conductors in a multi-terminal FFC. By reducing the free-space gaps between the terminals, the flares 180 facilitate self-alignment of the FFC Female Receptacle Pins 220 to the Terminal Bases 110 in a dimension parallel to the substrate 140.

Though the multiple terminals depicted in FIG. 4 are shown as a two subsets, one with flares and the other without, there is no need for terminals to be grouped in any particular manner; they may be mixed in any desired configuration. If desired, a particular layout that mixes flared and non-flared terminals may be used to enforce polarity or to ensure compatibility of a cable with a matching connector.

Figure 5:
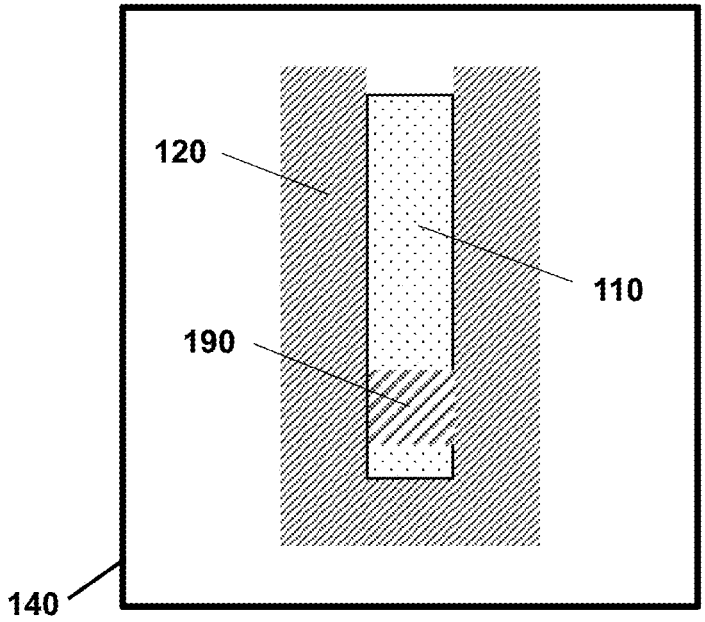
FIG. 5 shows in a top view a single terminal connector with an End Stop.

FIG. 5 adds an additional feature in the form of an end stop 190. The end stop is placed within the Connection Terminal 130 in the channel formed by the Terminal Base 110 and the Terminal Alignment Guide 120. It is set in a position along the length of the Connection Terminal 130 to limit the extent of engagement within the connector. For connectors in which the FFC female receptacle pin 220 is slid into place onto the male connection terminal 130, the end stop 190 provides a firm, repeatable connection. This is important where the circuits being connected may be sensitive to the impedance of the connector interface which can be affected by the penetration depth of the contact, that is, by the extent of engagement between the terminal and the receptacle pin.

The material used for the end stop 190 may be the same or different than that used for the connection terminal depending upon the purpose for which the end stop is intended. If intended for impedance control, a specific dielectric material may be desirable.

Though the above discussion has described specific features of Flat Flexible Cable connectors, it will be recognized by those skilled in these arts that many variations and combinations of the described embodiments are possible with application to other forms of conductors and connectors. In particular, the connections described here are fully scalable to accommodate self-alignment of terminals of any dimension or pitch. Therefore, this particular description should not impose any limitation on the disclosed matter, the scope of which is to be defined by reference to the appended claims.

What is claimed is:

1. A terminal for a Flat Flexible Cable (FFC), the terminal comprising:

a terminal base; and a terminal alignment guide, wherein the terminal base and the terminal alignment guide are formed together of a conductive material; and wherein the terminal is affixed to a substrate upon which is, an electrical interconnect, the terminal contacting the electrical interconnect on a tail of the FFC, and wherein the terminal alignment guide extends away from the substrate on opposing sides of the terminal base as a pair of sidewalls which with the terminal base form a channel, and wherein the terminal alignment guide is capable to direct a receptacle pin of a FFC receptacle to engage the terminal when the FFC is captured by the FFC receptacle.

2. The terminal of claim 1, wherein, at an open end of the terminal alignment guide opposite the interconnect, flares extend the terminal alignment guide adjacent to the substrate and outward away from the terminal base.

3. The terminal of claim 1, further comprising an end stop, wherein the end stop extends away from the terminal base within the terminal alignment guide, and wherein the end stop is placed at a position within the terminal alignment guide to limit an extent of engagement between the terminal and the receptacle pin.

4. A Flat Flexible Cable comprising a multiplicity of the terminals of claim 1, each terminal of the multiplicity of the terminals being parallel to each other to accommodate a multi-terminal connector.

5. The Flat Flexible Cable of claim 4, wherein for a subset of terminals from the multiplicity of the terminals the terminal alignment guide has flares extending adjacent to the substrate and outward away from the terminal base.

* * * * *